US006283300B1

(12) United States Patent
Bielagus et al.

(10) Patent No.: US 6,283,300 B1
(45) Date of Patent: Sep. 4, 2001

(54) FEED DISTRIBUTION FOR LOW VELOCITY AIR DENSITY SEPARATION

(76) Inventors: Joseph B. Bielagus, 21508 SW. Christiansen, Tualatin, OR (US) 97062; James R. Montgomery, 1311 SW. Royal Ct., Gresham, OR (US) 97080

( * ) Notice: Subject to any disclaimer, the term of this patent is extended or adjusted under 35 U.S.C. 154(b) by 0 days.

(21) Appl. No.: 09/138,251

(22) Filed: Aug. 21, 1998

(51) Int. Cl.[7] ..... B07B 9/00; B07B 4/00

(52) U.S. Cl. ..... 209/29; 709/139.1; 709/932

(58) Field of Search ..... 209/29, 138, 139.1, 209/142, 932, 146, 147, 153, 247, 250, 254

(56) References Cited

U.S. PATENT DOCUMENTS

| | | | |
|---|---|---|---|
| 1,661,299 | | 3/1928 | Peron . |
| 2,679,316 | | 5/1954 | Ruepp . |
| 2,828,011 | | 3/1958 | Whitby . |
| 2,852,137 | | 9/1958 | Hagopian . |
| 3,384,233 | | 5/1968 | Bolles . |
| 3,848,744 | | 11/1974 | Flaherty . |
| 4,166,027 | | 8/1979 | Smith . |
| 4,170,549 | | 10/1979 | Johnson . |
| 4,280,903 | | 7/1981 | Scholten . |
| 4,465,194 | | 8/1984 | Coleman . |
| 4,486,300 | | 12/1984 | Prieb . |
| 4,915,824 | | 4/1990 | Surtees . |
| 5,110,453 | | 5/1992 | Montgomery . |
| 5,579,920 | * | 12/1996 | Garabedian et al. ..... 209/139.1 |
| 5,829,597 | * | 11/1998 | Bielagus ..... 209/29 |

FOREIGN PATENT DOCUMENTS

| | | |
|---|---|---|
| 154876 | 9/1985 | (EP) . |
| 400326 | 3/1909 | (FR) . |
| 545573 | 12/1921 | (FR) . |
| 828125 | 1/1937 | (FR) . |
| 1181399 | 8/1957 | (FR) . |
| 574908 | 2/1946 | (GB) . |
| 2105223 | 3/1983 | (GB) . |
| 1599136 | 3/1988 | (SU) . |
| PCTUS8900896 | 4/1986 | (WO) . |
| PCTUS9512095 | 4/1996 | (WO) . |

OTHER PUBLICATIONS

The New Rader LVAS™ . . . High Performance Separation for Difficult Applications, Rader Companies, Apr. 1997.

* cited by examiner

*Primary Examiner*—Donald P. Walsh
*Assistant Examiner*—Brett A Martin

(57) ABSTRACT

Air is drawn upwardly through a vertical air separation chamber with an open bottom. Material to be separated is introduced into the rising stream of air. Material having a smaller ballistic cross-section rises, while heavier material falls through the open bottom. The air stream is controlled to below about 1,500 feet per minute. The dispersion of the material is accomplished with a jet of air taken from a plenum connected to an air recirculation system. The air jet is introduced immediately below the material inlet to the chamber. The jet of air breaks up and disperses the material. An air recirculation system includes a fan which draws air out of the top of the air separation chamber by way of a hydrocyclone. The air extracted from the hydrocyclone is reintroduced at the bottom of the air separation chamber from a surrounding plenum.

17 Claims, 3 Drawing Sheets

FEED DISTRIBUTION FOR LOW VELOCITY AIR DENSITY SEPARATION

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates in general to apparatuses and methods for separating fractions of a particulate material. More particularly, the present invention relates to apparatuses and methods for utilizing air to separate components of a particulate material on the basis of differing attributes.

The separation of a particulate material into various fractions on the basis of density is performed in many industrial processes. In the mining industry, heavy minerals are concentrated from ores for extraction. In agriculture, grain is separated from chaff and leaves are separated from stalks by a current of air that lifts the lighter chaff or leaves away from the grain or stalks. In the wood pulping industry, a device known as an air density separator has been employed to separate light wood chips from chips containing knots which are more dense.

An air density separator uses a vertical separation chamber through which a stream of air is drawn. Wood chips to be separated are metered by an auger into the separation chamber where the high velocity air stream disperses the chips evenly over the chamber. The more dense knots fall through the uprising current of air and are rejected. The lighter chips are drawn from the separation chamber by the flow of air and separated from the air by a cyclone.

In the production of paper from wood fibers, the wood fibers must be freed from the raw wood. One widely used method of accomplishing this is to process the wood fibers in a cooking liquor so that the material holding the fibers together, lignin, is dissolved. To achieve rapid and uniform digestion by the cooking liquor, the wood, after it has been debarked, is passed through a chipper that reduces the raw wood to chips.

As a natural consequence of the harvesting and processing of pulp logs, some sand, rocks, and tramp metal find their way into the raw wood chips. Further, a certain percentage of the raw wood is comprised of knots which are in general undesired in the papermaking process because they add dark fibers that increase the bleaching requirement and because they contain resinous material. The knots, which are typically of a higher density because the wood is dense and resinous, together with tramp metal and rocks, must be separated from the raw wood chips before further processing.

One highly successful method of accomplishing this separation is the air density separator. In one known successful system, chips are supplied by a metering screw conveyor infeed to a separation chamber through which a stream of air is drawn. The chips are entrained in the air stream while the higher density knots, stones and tramp metal move against the current of air under the force of gravity. The acceptable chips and air then pass into a cyclone where the chips are separated from the air, the air being drawn by a vacuum into a fan and exhausted.

While the air density separator is the most effective and discriminating system available, it has some less desirable features. First, it requires a baghouse to remove dust from the exhaust air. The baghouse is expensive and requires labor intensive maintenance. Further, use of a baghouse results in higher energy cost because of the air pressure necessary to move the air through the filters. Conventional air density separators using air velocities of 4,000 to 5,000 feet per minute function well at dispersing and separating larger wood chips from knots, rocks, and tramp metal. However, separation of small chips from sand and dust requires a lower velocity air flow. Here the conventional method of dispersing the material to be separated in the air stream is not effective.

What is needed is an air density separator that eliminates the requirement for a baghouse and can process lightweight materials in a low velocity air stream.

SUMMARY OF THE INVENTION

The air density separation apparatus of the present invention draws a stream of air up through a vertical air separation chamber that has an open bottom. Material to be separated is introduced into the rising stream of air and material having a smaller ballistic cross-section rises while more dense material falls through the open bottom of the separation chamber. Because the air stream is used to separate materials of low density, the velocity of the air stream is controlled to be below about 1,500 feet per minute. The air stream, because of its low velocity, does not produce sufficient turbulence or dynamic pressure to disperse the material within the upwardly moving column of air. The dispersion of the material is accomplished with a jet of air taken from a plenum connected to an air recirculation system. The air jet is introduced immediately below the material inlet to the vertical air separation chamber. The jet of air breaks up and disperses the material so that the upwardly moving column of air can be used to separate the components of the material introduced. The air recirculation system has a fan which draws air out of the top of the air separation chamber by way of a hydrocyclone. The air extracted from the hydrocyclone is reintroduced at the bottom of the vertical air separation chamber from a plenum which surrounds the open bottom of the vertical chamber. Recirculation of air can eliminate the need to separate entrained dust with a baghouse by a process wherein, through recirculation, the dust forms larger particles which are removed by the hydrocyclone.

The strength of the air jet used to distribute the material introduced into the air separation chamber is adjustable by a baffle which controls the width of a slot opening which produces the air jet. Approximately ten to twenty percent of the recirculating air is used to form the jet.

It is a feature of the present invention to provide an air density separator that does not require a baghouse.

It is another feature of the present invention to provide an air density separator that can handle lightweight materials using a low velocity air stream.

It is a further feature of the present invention to provide an air density separator which provides clumping of fines so they can more easily be removed from the air stream by a cyclone.

It is yet another feature of the present invention to provide an air density separator feed system which distributes lightweight materials into the air stream of the air chamber of an air density separator.

Further objects, features and advantages of the invention will be apparent from the following detailed description when taken in conjunction with the accompanying drawings.

DESCRIPTION OF THE PREFERRED EMBODIMENT

Figure 1:
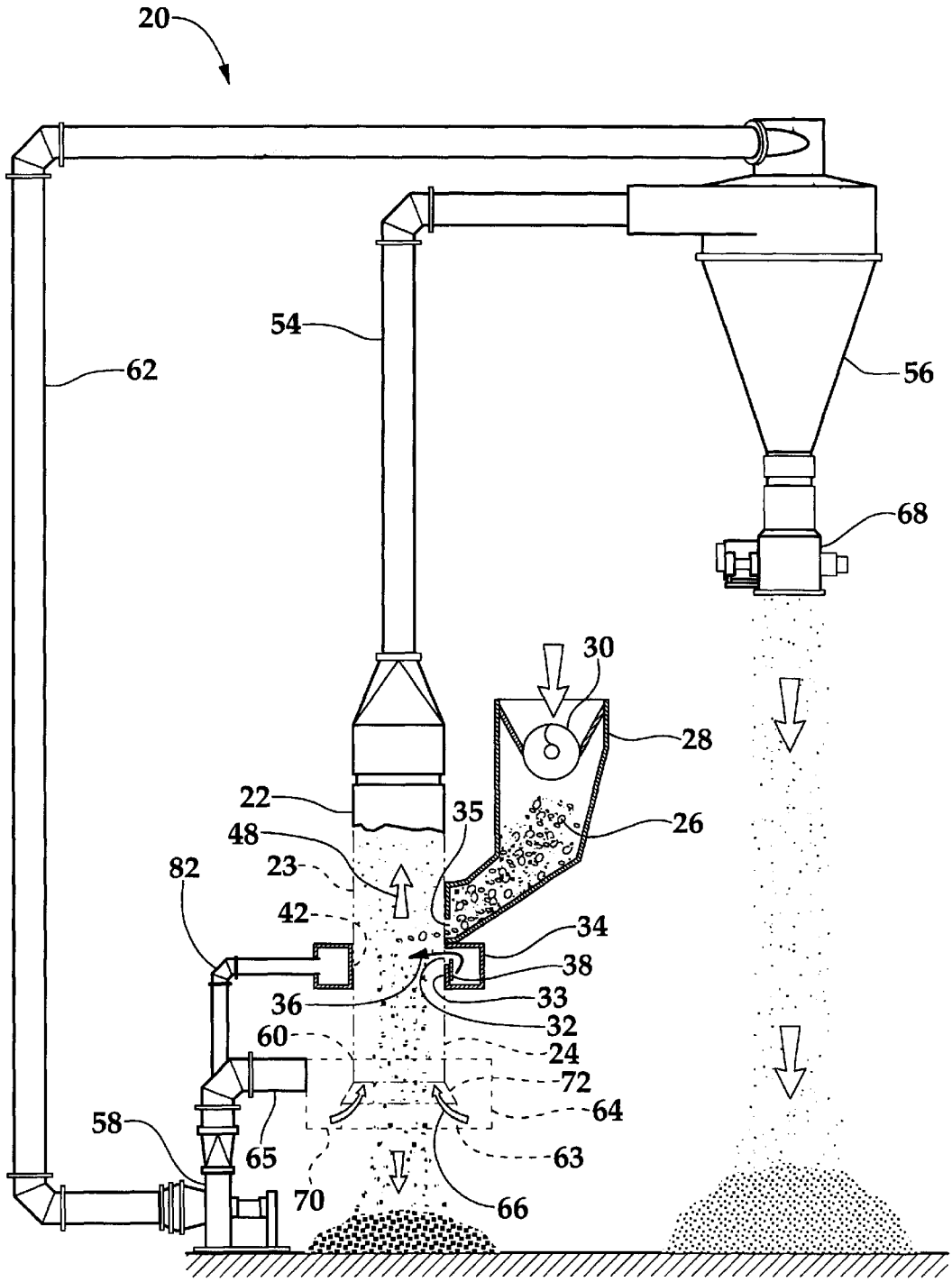
FIG. 1 is a side elevational view, partially cut-away in section and somewhat schematic view of the air density separator of this invention.
Figure 2:
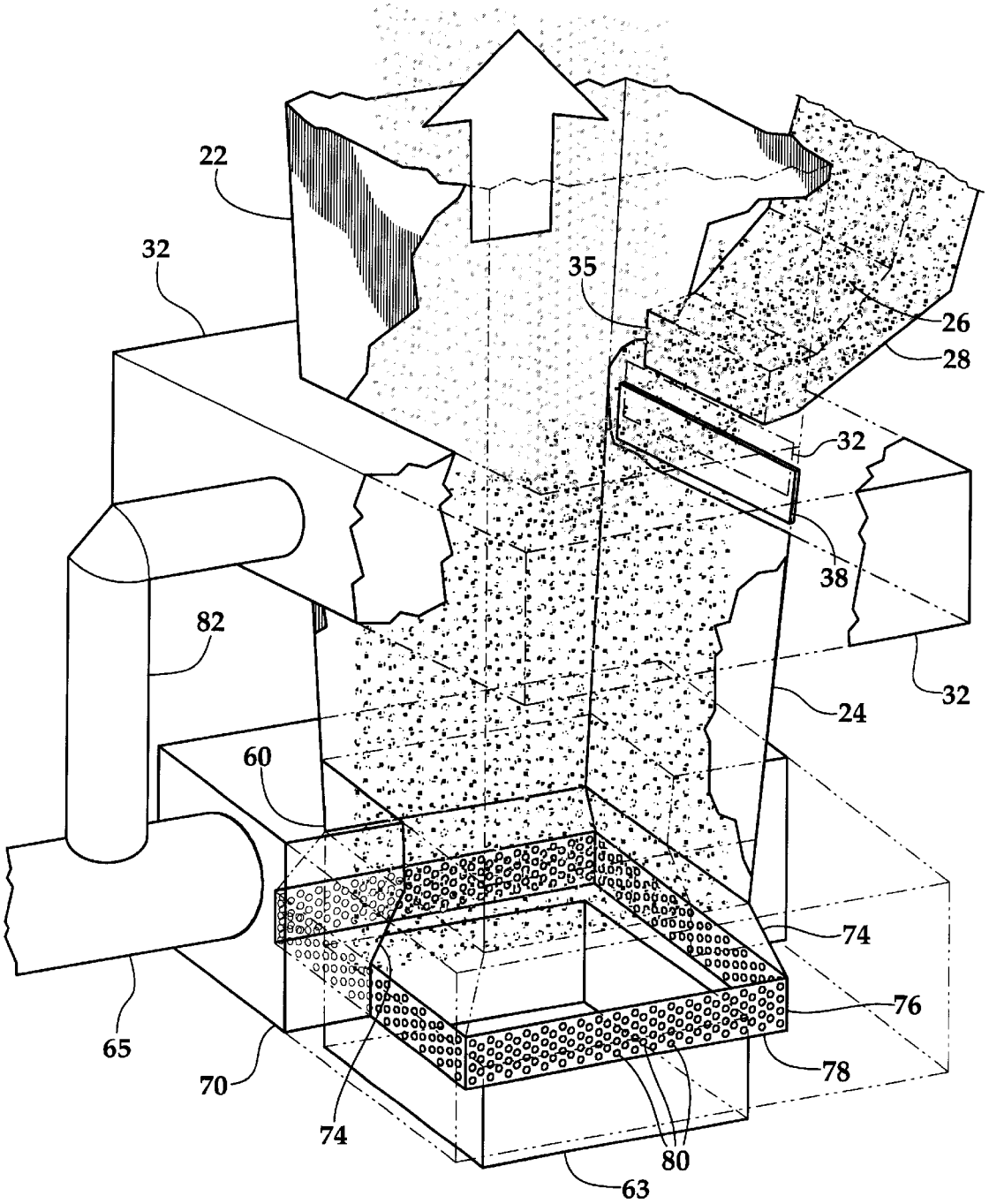
FIG. 2 is an isometric view, partially cut-away in section, of the separation chamber and infeed mechanism of the air density separator of FIG. 1.
Figure 3:
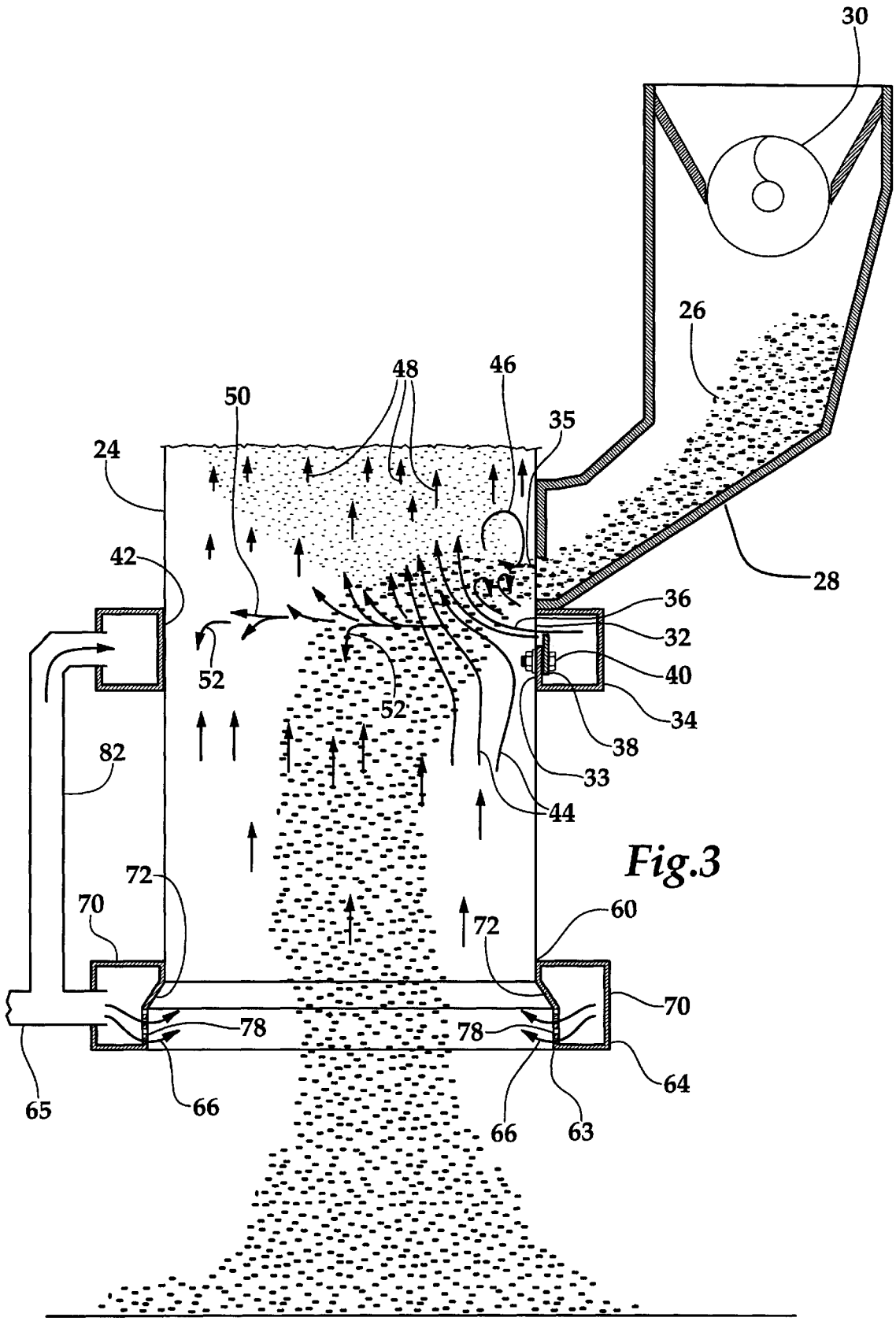
FIG. 3 is a schematic view of the air and particle paths within the lower portion of the separation chamber of FIG. 2.

Referring more particularly to FIGS. 1–3, wherein like numbers refer to similar parts, an air density separator 20 is shown in FIG. 1. The air density separator 20 has a vertically disposed chamber 22 with walls 23 which define a vertical air separation chamber 24. As shown in FIG. 3, mixed particulate material 26 to be separated is introduced into the separation chamber 24 from a material hopper 28 through a material inlet 35. An auger 30 is provided to distribute the particulate material 26 across the hopper 28. However, depending on the feed system and the natural angle of repose of the material 26, baffles alone may be substituted for the auger 30.

In the air density separator 20 dispersion of the material 26 is accomplished by a jet or curtain of air formed by an adjustable slot 32 in the wall 33 directly below the material inlet 35. The slot 32 allows air from a plenum 34 to enter the separation chamber 24. Air in the plenum is at a higher pressure than air in the chamber 24, so the pressure drop as the air passes through the slot 32 accelerates the air passing through the slot to form the jet indicated by arrows 36. The size and velocity of the jet is controlled by a movable damper 38 which is held in place by screws 40. As material 26 flows through an opening 35 into the separation chamber 24, it falls through the jet of air flowing from the slot 32. The effect of the jet is to disperse the material 26 and accelerate the material towards the opposite side 42 of the chamber 24 opposite the slot 32.

A flow of air, indicated by arrows 44, is introduced at the base of the recirculation chamber, and flows upwardly. Where the upwardly flowing air meets the air from the jet exiting the slot 32, a turbulent recirculation zone is formed, indicated by arrows 46. Material 26 caught in the recirculation zone, if it is lightweight, travels upwardly with the upwardly moving air indicated by arrows 48. If heavy material is caught in the recirculation zone, it falls downwardly where it is accelerated by the air jet from the slot 32. Arrows 50 in FIG. 3 show the trajectory of that material which is caught by the air jet and accelerated. Such material entrained in the air jet moves out across the duct until air resistance slows the individual particles' lateral velocity and the particles are either drawn upwardly, as shown by arrows 48, or fall downward, as indicated by arrows 52, through the uprising air. The jet of higher velocity air formed by the slot 32 breaks up and disperses the material 26 to be separated. In a chamber having a rectangular cross-section with dimensions of approximately eight by two feet, the air curtain would be about one to two inches wide and extend across the width of the longer eighth foot chamber wall 33 beneath the material inlet 35.

The air density separator 20 is configured to recirculate the air and entrained fines. The entrained fines conglomerate and are removed by a cyclone 56 which eliminates the need for a baghouse in many circumstances and hence minimizes emissions without the cost associated with a baghouse to remove fines.

As shown in FIG. 1, the air separation chamber 24 is connected by a first duct 54 to the cyclone 56. A fan 58 is positioned adjacent the lower end 60 of the air separation chamber 24, and draws air through a second duct 62 out of the cyclone 56 for reintroduction into the air chamber 24. The fan 58 thus draws air through the first duct 54 from the air separation chamber 24. The fan 58 exhausts into the vertical air separation chamber 24 adjacent to the bottom 63 of the chamber 24 through a plenum 64 by way of a duct 65. A third duct 82 conducts ten to twenty percent of the total air moving through the fans 58 to the plenum 34 which supplies air to the slot 32 which forms the jet of air used to disperse the material 26 added to the separation chamber 24.

When the material 26 is introduced into the upwardly moving air stream within the air separation chamber 24, heavy particles fall down past the plenum 64 at the bottom 63 of the chamber 24. A stream of air, indicated by arrows 66, enters the chamber 24 from the plenum 64, and is drawn upward through the first duct 54 into the cyclone 56, where denser particles are thrown outwardly to the walls of the cyclone. Most of the air and the less dense particles such as fines is drawn out of the cyclone 56 through the second duct 62 for reintroduction into the air separation chamber 24 at the plenum 64.

Materials having a lower ballistic coefficient, that is those which are lighter in proportion to their area, will be entrained in the upwardly moving air and will leave the separation chamber through the first duct 54. The remaining particulate material which is not entrained will exit the separation chamber 24 through the bottom 63 of the chamber 24. Material exiting the bottom of the chamber 24 may be collected on a conveyor or the like. Very lightweight dust and particles are too light to be removed by the cyclone 56 and thus recirculate with the air. Over time the fine particles conglomerate into larger clumps which the cyclone can remove. The precise mechanism for agglomeration is not fully understood but may include the dust grains developing an electrical charge which causes them to attract each other.

In a conventional air density separator, air is drawn up through the separation chamber at four to five thousand feet per minute while the granular material to be separated such as wood chips is dispensed into the air chamber either by a chute with an air lock or by an auger which distributes the material across the separation chamber. In a conventional air density separator the high velocity air stream moving up through the separation chamber is usually effective to disperse the granular material being separated in the air stream. Materials which are sufficiently dense fall down through the separation chamber whereas lighter materials become entrained in the air and are drawn into a cyclone where they are separated. The recirculating air density separator 20 shown in FIG. 1 may be used with any suitable air velocity for a particular application. However the use of an air curtain or jet is particularly advantageous where lightweight materials are being dispersed into a low velocity stream of air.

An air density separator separates a particulate material depending on what is known in the aerodynamic field as ballistic coefficient. Ballistic coefficient is a function of the density of the object, the area of the object presented to the air stream, and a shape-dependent coefficient. Thus, the ballistic coefficient of an object increases with its density, decreases with increasing area and decreases with increasing bluntness of the object facing the air stream. Ballistic coefficient controls the maximum rate at which an object will fall through a still column of air. Because resistance to motion of an object through the air increases with velocity, an object which is accelerated by the earth's gravitational force eventually reaches an equilibrium velocity where the acceleration force of gravity is balanced by the drag force produced by the air through which the object is moving.

This principal is used to separate the granular material into two or more components based on the ballistic coefficient of the granules. By introducing the granules into an upwardly moving stream of air which has a velocity which is greater than the terminal velocity of some of the particles and less than the terminal velocity of other particles, the granular material will be separated into two fractions. Thus, for separating wood chips from wood knots, an air velocity in the range of four to five thousand feet per minute is chosen which exceeds the terminal velocity of the wood chips, thereby causing them to rise to the top of the air chamber and be transported through a duct to a cyclone. On the other hand, the knots, which have a terminal velocity greater than four to five thousand feet per minute, fall through the air to exit the bottom of the separation chamber.

An exemplary problem addressed by the low velocity air density separator 20 is separating small wood chips and sawdust from sand and dirt. The high cost of wood fiber combined with a desire to minimize waste has produced a demand for the capability to recover wood fiber from material which may have been discarded in the past. Because wood chips, sawdust fines and needles of wood are of lower density than the sand and dust with which they are mixed, they have a higher ballistic co-efficient and can be separated in theory in an air density separator. However, all small particles have relatively low ballistic coefficients because the area of the particle dominates as particles become smaller. To separate particles with low ballistic coefficients the velocity of the air in the air density separator must be lower, preferably in the range of five hundred to a thousand feet per minute.

The problem with using these low velocities in an air density separator can be readily demonstrated by taking a handful of paper confetti such as the punchings from a paper punch and dropping them into the air. Some of the paper punchings will become dispersed and rapidly reach their terminal velocity and slowly settle to the floor. Others, however, will clump together and fall as a unit reaching the floor before the dispersed punchings. Thus, with lightweight materials, they must be adequately dispersed in the column of air moving up through the vertical air separation chamber 24 if it is desired to reliably separate them on the basis of their ballistic coefficients. The relatively slow upward moving stream of air in the air separation chamber 24 is insufficient to reliably disperse the lightweight material.

The cyclone 56 uses centrifugal forces to separate the majority of the particulate material from the air stream. The cyclone has an air lock 68 which allows the lighter fraction to be removed from the cyclone. The air that is withdrawn from the cyclone passes through the fan 58 and is then reinjected into the bottom 63 of the of the air separation chamber 24 through the plenum 64. The plenum 64 is a rectangular box 70 which is fed tangentially with air from the fan 58. Portions 72 of the walls 74 of the air separation chamber 24 adjacent to the plenum 64 are angled into the plenum 64. The gap 76 between the angled portions 72 and the wall 74 of the plenum 64 is closed with a grid of metal 78 with ½ inch holes 80. The gap 76 forms a continuous opening about the circumference of the chamber 24. The grid 78 produces a pressure drop as air moves from the plenum 64 into the separation chamber 24. The pressure drop helps to equalize the air flow into the chamber 24.

It should be understood that the low velocity air density separator of this invention may be used to separate shredded post-consumer plastic containers. The recycling of post-consumer plastic bottles results in a feed stock formed by the shredding of plastic milk bottles or plastic pop bottles. The feed stock contains both plastic from the bottles and paper from the labels associated with the bottles. Because the plastic shards are of a thicker gauge of material than the paper or light grade plastic labels, they can be separated in an air density separator. The velocity of the air in the air density separator will be preferably in the range of seven to eight hundred feet per minute.

It should also be understood that the precise amount of air injected into the separation chamber will depend on the size of the air separator and the material being separated. However, the amount of air will generally be about ten to twenty percent, if the air injected through the slot is too great, the injection of air will result in too great a difference in air velocity above and below the air injection point. Control of the air injected can be used as an additional variable which can be controlled to adjust the separation conditions within the air density separator 20. U.S. Pat. No. 5,829,597 is incorporated herein by reference.

It is understood that the invention is not limited to the particular construction and arrangement of parts herein illustrated and described, but embraces such modified forms thereof as come within the scope of the following claims.

We claim:

1. An apparatus for separating mixed particulate material comprising:

a substantially vertically extending chamber having walls with a top and a downwardly open bottom, the walls defining a passage for the upward flow of air;

a duct connected to the top of the chamber and joined thereto so as to allow air to be drawn up through the chamber;

a cyclone connected to receive air from the duct;

a fan having an inlet and an outlet, the inlet connecting to the cyclone to draw air through the cyclone, the fan outlet connected to the chamber beneath the particulate material inlet to cause air to recirculate through the chamber and the cyclone;

a chute for conducting material to be separated into the chamber;

portions of one of the chamber walls which define a first opening, wherein material to be separated passes along the chute and through the first opening into the chamber;

portions of the one wall defining a second opening positioned below the first opening; and a source of air communicating with the second opening so that air from the source supplies a jet of air which passes into the chamber from the second opening, the jet of air for dispersing material into the upward flow of air through the chamber; and a duct communicating between the fan outlet, the fan thereby comprising the source of air.

2. The apparatus of claim 1 wherein the outlet of the fan is connected to a plenum adjacent to the open bottom, the plenum supplying air to the chamber through portions of the chamber walls forming openings to allow air from the plenum to enter the chamber.

3. An apparatus for separating mixed particulate material comprising:

a substantially vertically extending chamber having walls with a top and a downwardly open bottom, the walls defining a passage for the upward flow of air;

a duct connected to the top of the chamber and joined thereto so as to allow air to be drawn up through the chamber;

a cyclone connected to receive air from the duct;

a fan having an inlet and an outlet, the inlet connecting to the cyclone to draw air through the cyclone, the fan outlet connected to the chamber beneath the particulate material inlet to cause air to recirculate through the chamber and the cyclone;

a chute for conducting material to be separated into the chamber;

portions of one of the chamber walls which define a first opening, wherein material to be separated passes along the chute and through the first opening into the chamber;

portions of the one wall defining a second opening positioned below the first opening; and a source of air communicating with the second opening so that air from the source supplies a jet of air which passes into the chamber from the second opening, the jet of air for dispersing material into the upward flow of air through the chamber; and a damper adjustably affixed to the one wall to adjust the size of the second opening so that the strength of the air jet may be adjusted.

4. The apparatus of claim 3 wherein the damper is positioned to allow ten to twenty percent of the air supplied by the fan to recirculate through the second opening.

5. An air density separator comprising:

a substantially vertically extending chamber having walls with a top and a downwardly open bottom, the walls defining a passage for the upward flow of air, and a first opening which admits mixed particulate material into the chamber at a position between the top and the bottom;

portions of one of the chamber walls which define a second opening positioned beneath and adjacent to the first opening;

a duct connected to the top of the chamber and joined thereto so as to allow air to be drawn up through the chamber;

a cyclone connected to receive air from the duct;

a fan having an inlet and an outlet, the fan inlet connecting to the cyclone to draw air through the cyclone, the fan outlet connected to the chamber beneath the first opening to cause air to recirculate through the chamber and the cyclone, wherein the outlet of the fan is connected to a plenum adjacent to the open bottom, the plenum supplying air to the chamber through portions of the chamber walls forming openings to allow air from the plenum to enter the chamber; and a duct connecting the outlet of the fan to the second opening so that a portion of the air drawn through the cyclone enters the chamber through the second opening forming a jet to disperse the mixed particulate material.

6. The apparatus of claim 5 further comprising a damper adjustably affixed to the one chamber wall, to adjust the size of the second opening so that the strength of the air jet may be adjusted.

7. The apparatus of claim 6 wherein the damper is positioned to allow ten to twenty percent of the air supplied by the fan to recirculate through the second opening.

8. An apparatus for separating mixed particulate material comprising:

a substantially vertically extending chamber having walls with a top and a downwardly open bottom, the walls defining a passage for the upward flow of air, and portions of one of the walls forming a first opening which admits mixed particulate material into the chamber at a position between the top and the bottom;

a portion of the one wall forming a second opening, the second opening positioned closely spaced beneath the first opening;

a duct connected to the top of the chamber and joined to the chamber so as to allow air to be drawn up through the chamber;

a cyclone connected to receive air from the duct; and a fan having an inlet and an outlet, the inlet connecting to the cyclone to draw air through the cyclone, the fan outlet connected to the chamber beneath the first opening to cause air to recirculate through the chamber and the cyclone, and the fan outlet being also connected to the second opening so as to form a jet of air comprising about ten to about twenty percent of the air which is caused to recirculate through the chamber and the cyclone, the air jet for dispersing the mixed particulate material.

9. The apparatus of claim 8 further comprising a feed chute leading into the first opening into the chamber and positioned above the opening through which the jet of air passes.

10. The apparatus of claim 8 wherein the outlet of the fan is connected to a plenum adjacent to the open bottom, the plenum supplying air to the chamber through openings in the plenum to allow air from the plenum to enter the chamber.

11. The apparatus of claim 10 wherein the chamber walls are angled outwardly into the plenum above the openings in the plenum.

12. The apparatus of claim 10 wherein the openings in the plenum are closed with a grid of metal which allows the passage of air while producing a pressure drop which facilitates the even distribution of air from the plenum into the chamber.

13. The apparatus of claim 10 wherein the openings in the plenum form a continuous opening around a perimeter of the chamber.

14. A method for separating a granular material comprising the steps of:

delivering a stream of granular material to an opening in the side of an enclosed chamber with an open bottom, wherein the granular material has at least two components having differing terminal velocities; and drawing a current of air up through the chamber from the open bottom with a fan such that the air passes upwardly through the chamber;

dispersing the granular material within the chamber by directing a jet of air at the granular material as it enters the chamber;

separating the granular material into two components on the basis of the terminal velocity of the material in the current of air; and processing the current of air through a cyclone to separate one component of the granular material:

returning a first portion of the current of air from the fan to a plenum adjacent to the open bottom, and supplying air from the plenum through portions of the chamber walls forming openings to allow air from the plenum to enter the chamber so the current of air repeatedly circulates through the chamber; and returning a second portion of the current of air from the fan to the enclosed chamber as the jet of air, so that the current of air recirculates repeatedly through the chamber.

15. The method of claim 14 wherein the granular material being separated is comprised of wood chips and sand.

16. The method of claim 14 wherein the second portion of the current of air consists of about ten to about twenty percent of the current of air drawn from the fan.

17. An apparatus for separating a mixed particulate material having at least two components of differing terminal velocities, the apparatus comprising:

a substantially vertically extending chamber having a bottom open to the atmosphere and a top which is connected to a duct, allowing a stream of air to be drawn from the bottom to the top of the chamber;

a first opening in the side of the chamber connected to a means for supplying particulate material;

a fan providing a source of air at a pressure higher than the pressure within the chamber;

a first plenum connected to the source of air provided by the fan, the first plenum communicating with a second opening in the vertically extending chamber, wherein the second opening is positioned adjacent to and below the first opening;

a cyclone in receiving relation with the duct at the top of the chamber, wherein the component of the mixed particulate material having a lower terminal velocity is entrained in the air received in the cyclone and is separated from the air therein; and the fan having an inlet connected to the cyclone for pulling the stream of air through the chamber and the cyclone, the fan having an outlet connected to the bottom of the chamber so that air drawn from the cyclone is recirculated through the chamber, wherein the outlet of the fan is connected to a second plenum adjacent to the open bottom, the plenum supplying air to the chamber through portions of the chamber walls forming openings to allow air from the second plenum to enter the chamber.

* * * * *